US008716616B2

(12) United States Patent
Forsberg et al.

(10) Patent No.: US 8,716,616 B2
(45) Date of Patent: May 6, 2014

(54) MAIN SWITCH FOR ELECTRICAL SYSTEMS OF VEHICLES

(75) Inventors: Per Anders Forsberg, Legnago (IT); Massimiliano Tinto, Legnago (IT)

(73) Assignee: Menber's S.p.A., Lagnago (Verona) (IT)

( * ) Notice: Subject to any disclaimer, the term of this patent is extended or adjusted under 35 U.S.C. 154(b) by 214 days.

(21) Appl. No.: 13/252,652

(22) Filed: Oct. 4, 2011

(65) Prior Publication Data

US 2012/0085630 A1 Apr. 12, 2012

(30) Foreign Application Priority Data

Oct. 5, 2010 (IT) ..... TO100161 U

(51) Int. Cl.
*H01H 1/64* (2006.01)

(52) U.S. Cl.
USPC ..... 200/293

(58) Field of Classification Search
USPC ..... 200/293, 296, 341–345, DIG. 2, 200/322–324, 327, 338, 532, 530, 200/61.54–61.57, 61.68, 61.81, 248; 411/172, 175, 398, 166, 157; 403/3, 4, 403/409.1, 350; 280/86.753; 439/504, 573, 439/564, 565

See application file for complete search history.

(56) References Cited

U.S. PATENT DOCUMENTS

| | | | | |
|---|---|---|---|---|
| 4,911,417 | A * | 3/1990 | Short | 267/256 |
| 5,141,357 | A * | 8/1992 | Sherman et al. | 403/408.1 |
| 7,369,413 | B2 * | 5/2008 | Caines et al. | 361/719 |
| 8,337,132 | B2 * | 12/2012 | Steffenfauseweh et al. | 411/539 |
| 2006/0088398 | A1 * | 4/2006 | Lund | 411/155 |
| 2010/0258413 | A1 * | 10/2010 | Leischner et al. | 200/11 R |

* cited by examiner

*Primary Examiner* — Renee Luebke
*Assistant Examiner* — Harshad Patel
(74) *Attorney, Agent, or Firm* — Patterson & Sheridan, L.L.P.

(57) ABSTRACT

A main switch for electrical systems of vehicles, comprising an outer casing projecting from which is a plurality of electrical contacts that are to be connected to cables of the electrical system, wherein the casing has a base that is to rest on a supporting plate of the vehicle, said base being fixed by means of screws to the supporting plate, wherein the base is provided with two pairs of fixing elements having respective holes that are to be engaged by said screws, said fixing elements being insertable in the respective seats of the base in two different positions to which there correspond different distances between the centers of the fixing elements of each pair.

7 Claims, 4 Drawing Sheets

MAIN SWITCH FOR ELECTRICAL SYSTEMS OF VEHICLES

CROSS-REFERENCE TO RELATED APPLICATIONS

This application claims benefit of Italian patent application serial number TO2010U000161, filed Oct. 5, 2010, which is herein incorporated by reference.

BACKGROUND OF THE INVENTION

1. Field of the Invention

The present invention relates to a main switch for electrical systems of vehicles, which can be used, for example, on lorries, buses, watercraft, earth-moving machinery, etc.

A main switch of a vehicle, also referred to as battery-detachment switch, has the function of isolating the electrical system of the vehicle from the supply sources (batteries, alternator, etc.). Battery-detachment switches are generally provided on large lorries, pleasure boats and, in general, on vehicles with electrical systems with a relatively high power. Said switches are generally able to interrupt electric currents also of the order of hundreds of amps.

2. Description of the Related Art

In many cases, the position of the electrical contacts of the switch does not correspond to the position of the cables of the vehicle, and there is frequently the need to mount the switch on the vehicle with a different orientation.

SUMMARY OF THE INVENTION

The object of the present invention is to provide a particularly simple solution that will enable the main switch to be mounted with a different orientation on the vehicle.

According to the present invention, said object is achieved by a main switch having the characteristics forming the subject of the claims.

BRIEF DESCRIPTION OF THE DRAWINGS

The characteristics and advantages of the present invention will emerge clearly in the course of the ensuing detailed description, which is provided purely by way of non-limiting example and in which.

DETAILED DESCRIPTION

Figure 1:
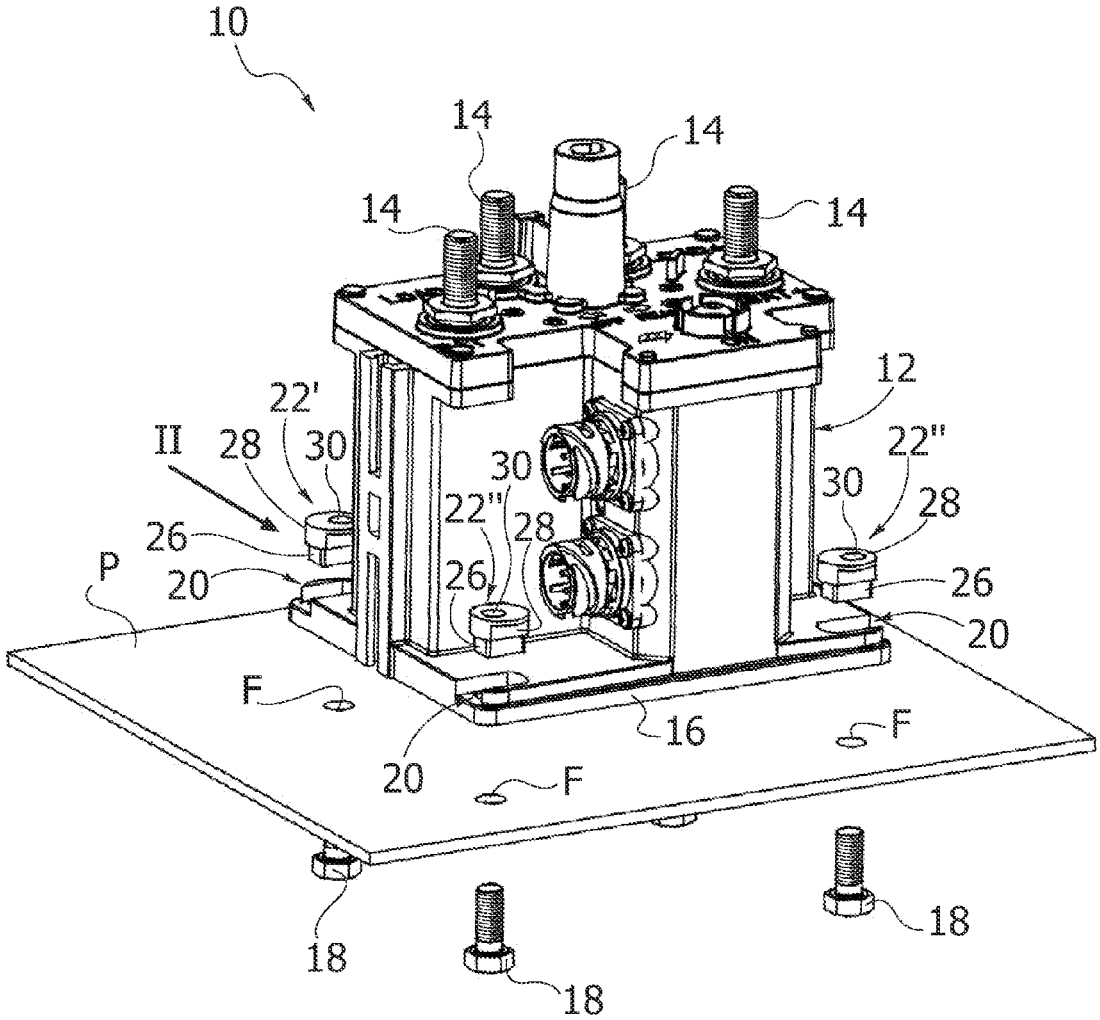
FIG. 1 is a partially exploded perspective view of a main switch according to the present invention.

With reference to FIG. 1, designated by 10 is a main switch for electrical systems of vehicles according to the present invention. The switch 10 comprises an outer casing 12 projecting from which is a plurality of electrical contacts 14 in the form of a pin to which there are to be connected respective terminals of electric cables forming part of the electrical system on board a vehicle.

The casing 12 has a base 16 that is to rest on a supporting plate P of the vehicle. The supporting plate P is provided with four through holes F, which have the purpose of fixing the switch 10 to the plate P by means of screws 18.

Figure 2:
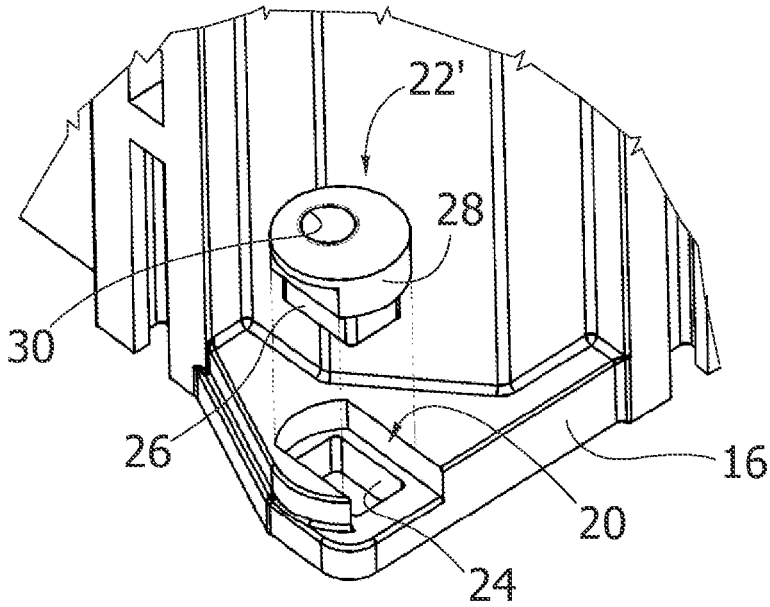
FIGS. 2 and 3 are perspective views of the part indicated by the arrow II in FIG. 1.
Figure 3:
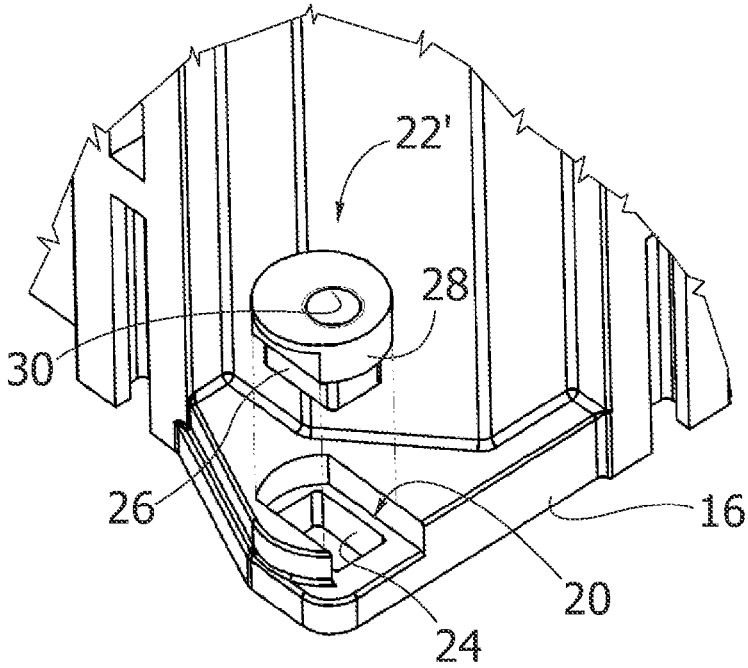

With reference to FIGS. 1-3, the base 16 of the switch 10 has four seats 20, each of which receives a respective fixing element 22', 22". The fixing elements 22', 22" are preferably identical to one another.

Each seat 20 has a rectangular through opening 24 elongated in a direction parallel to one of the main sides of the base 16. Each fixing element 22', 22" has a rectangular bottom portion 26 that couples to the through opening 24. Each fixing element 22', 22" has a head 28 that rests on the top part of the seat 20, above the through opening 24. Each fixing element 22', 22" has a threaded through hole 30, the axis of which is shifted with respect to the centre of the rectangular bottom portion 26.

As is illustrated in FIGS. 2 and 3, each fixing element 22', 22" can be inserted in the respective seat 20 with two different orientations. The two positions of installation of each fixing element 22', 22" are rotated through 180° with respect to one another. To each position of installation there corresponds a different position of the threaded through hole 30 with respect to the base 16.

Figure 4:
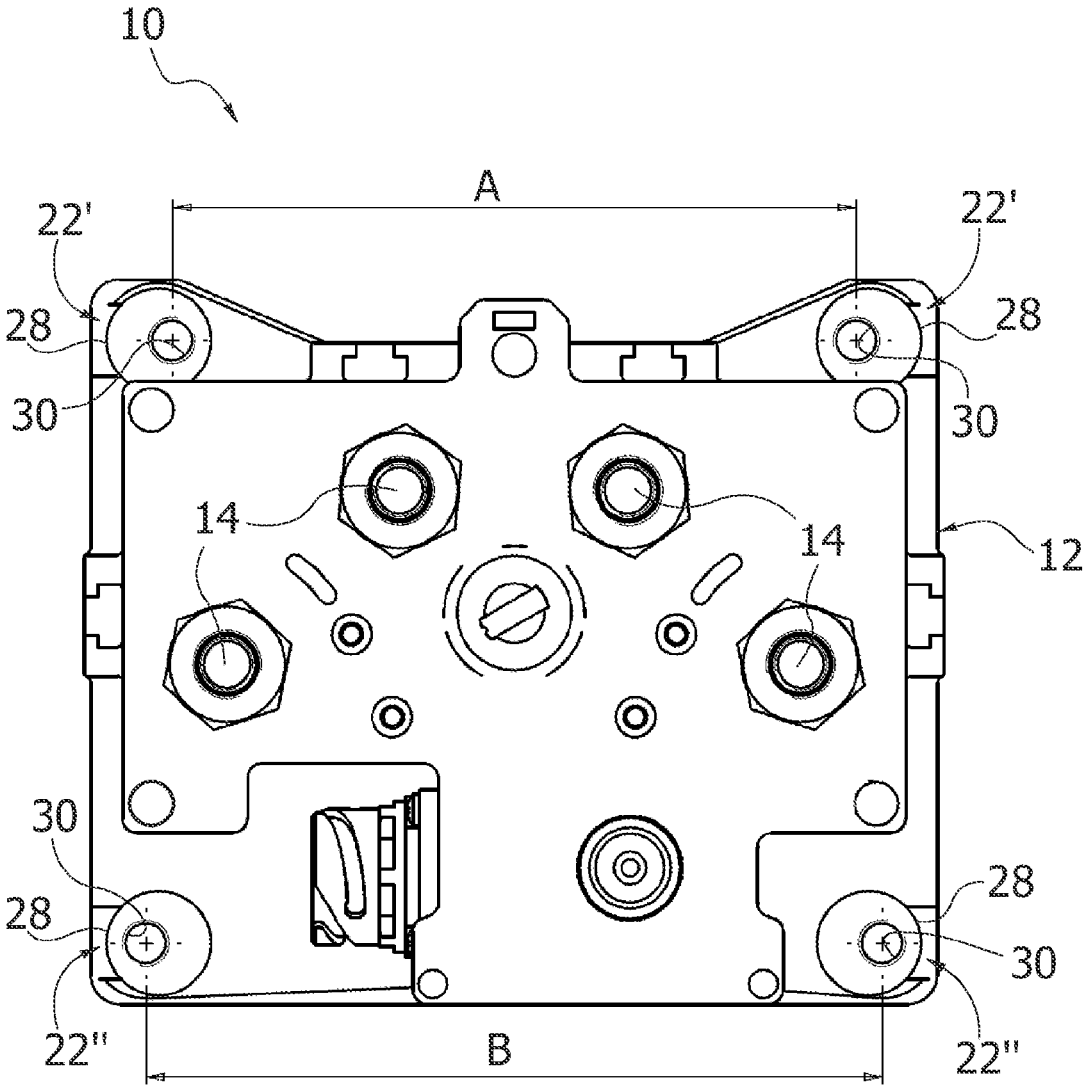
FIGS. 4 and 5 are top plan views of the main switch in two different positions of installation.

With reference to FIG. 4, in a first configuration of installation of the switch 10 a first pair of fixing elements 22' is mounted in a first position and a second pair of fixing elements 22" is mounted in a second position. The distance between the centres of the holes 28 of the first pair of fixing elements 22' has a value A equal, for example, to 118 mm, and the distance between the centres of the holes 30 of the second pair of fixing elements 22" has a value B equal, for example, to 127 mm.

Figure 5:
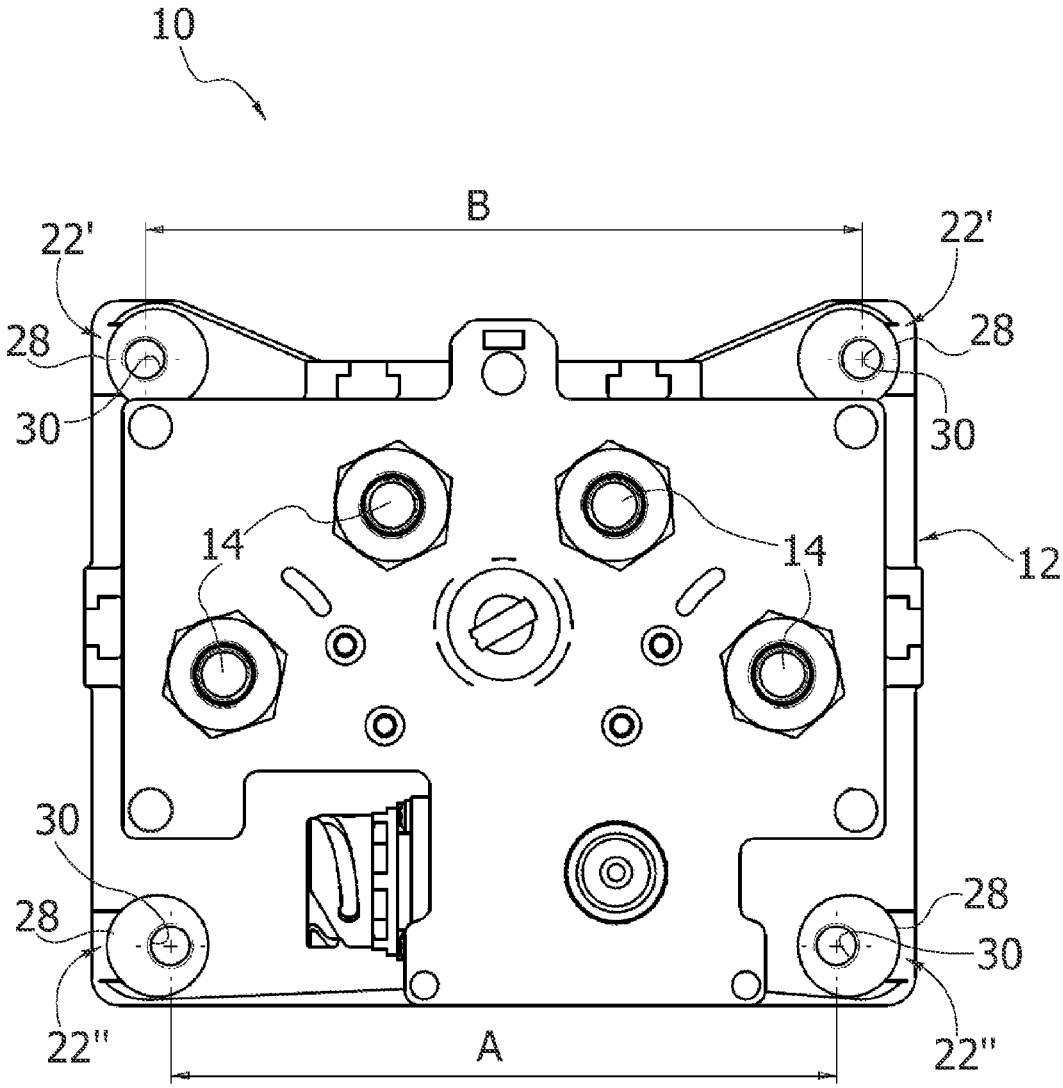

In a second configuration of fixing of the switch 10, illustrated in FIG. 5, the first pair of fixing elements 22' is set in the second position of installation, to which there corresponds a distance between the centres of the holes 30 equal to B, and the second pair of fixing elements 22" is mounted in the first position, to which there corresponds a distance between the centres of the holes 30 equal to A.

The fixing plate P of the vehicle on which the switch 10 is to be fixed the has two pairs of holes F, with distances between centres A and B, respectively. The screws 18 are inserted through the respective holes F and engage the threaded through holes 30 of the respective fixing elements 22 that are aligned to the respective holes F. The switch 10 according to the present invention can be mounted on the plate P in two positions rotated with respect to one another through 180°. To install the switch 10 in one or other of the positions it is sufficient to vary the orientation of the fixing elements 22', 22" in the respective seats 20.

Thanks to the present invention it is possible to install the switch 10 in the correct position without the need to provide adapter devices or different configurations of the casing for the different types of installation required. The variation of the orientation of the fixing elements 22', 22" in the respective seats 20 is made in a simple and fast way and without the need for dedicated tools.

Of course, without prejudice to the principle of the invention, the details of construction and the embodiments may vary widely with respect to what has been described and illustrated herein, without thereby departing from the scope of the invention as defined by the ensuing claims.

The invention claimed is:

1. A main switch for electrical systems of vehicles, comprising an outer casing, projecting from which is a plurality of electrical contacts that are to be connected to cables of the electrical system, wherein the casing has a base that is to rest on a supporting plate of the vehicle, said base being fixed by means of screws to the supporting plate, wherein the base is provided with two pairs of fixing elements having respective holes that are to be engaged by said screws, said fixing elements being insertable in seats of the base in two different positions to which there correspond different distances between the centres of the fixing elements of each pair, and wherein each of said fixing elements has a bottom portion with a rectangular cross section that fits with two opposite orientations in a through opening of each seat.

2. The main switch according to claim 1, wherein the axis of the hole of each fixing element is shifted with respect to the centre of said bottom portion with the rectangular cross section.

3. The main switch of claim 1, wherein the fixing elements include a head having a round cross section, the head coupled to the bottom portion.

4. The main switch of claim 3, wherein the head is adapted to rest upon an upper surface of the seat.

5. The main switch of claim 4, wherein the head of each fixing element includes an upper portion having the round cross section, and a lower portion having two linear sides.

6. The main switch of claim 1, wherein the through opening of the respective seat is rectangular.

7. A main switch for electrical systems of vehicles, comprising:

an outer casing, and a plurality of electrical contacts projecting from the outer casing, the plurality of electrical contacts adapted to be connected to cables of the electrical system, wherein the casing has a base that is to rest on a supporting plate of the vehicle, said base adapted to be fixed by screws to the supporting plate;

wherein the base is provided with two pairs of fixing elements having respective holes that are to be engaged by said screws, said fixing elements being insertable in seats of the base in two different positions to which there correspond different distances between the centres of the fixing elements of each pair;

wherein each of said fixing elements includes:

a bottom portion with a rectangular cross section that fits with two opposite orientations in a rectangular through opening of each seat, and a head having an upper portion having a round cross section and a lower portion having two linear sides.

* * * * *